US009346156B1

(12) United States Patent
Fago

(10) Patent No.: US 9,346,156 B1
(45) Date of Patent: May 24, 2016

(54) SKEWED FASTENER TRACK FOR IMPROVED ALIGNMENT AND FASTENER DRIVABILITY

(71) Applicant: Senco Brands, Inc., Cincinnati, OH (US)

(72) Inventor: Frank M. Fago, Mason, OH (US)

(73) Assignee: Senco Brands, Inc., Cincinnati, OH (US)

( * ) Notice: Subject to any disclaimer, the term of this patent is extended or adjusted under 35 U.S.C. 154(b) by 618 days.

(21) Appl. No.: 13/745,933

(22) Filed: Jan. 21, 2013

Related U.S. Application Data

(60) Provisional application No. 61/601,487, filed on Feb. 21, 2012.

(51) Int. Cl.

| | |
|---|---|
| ***B25C 1/06*** | (2006.01) |
| ***B25C 1/00*** | (2006.01) |
| ***B25C 5/16*** | (2006.01) |
| *B25C 5/15* | (2006.01) |

(52) U.S. Cl.
CPC . *B25C 1/00* (2013.01); *B25C 1/001* (2013.01); *B25C 1/06* (2013.01); *B25C 5/16* (2013.01); *B25C 5/15* (2013.01)

(58) Field of Classification Search
CPC ..... B25C 1/04; B25C 1/041; B25C 1/047; B25C 1/06; B25C 5/13; B25C 5/15; B25C 1/001; B25C 5/16
USPC ..... 227/120, 130, 113, 109, 119, 142, 8
See application file for complete search history.

(56) References Cited

U.S. PATENT DOCUMENTS

| | | | | | |
|---|---|---|---|---|---|
| 2,575,455 | A * | 11/1951 | Lang | 227/138 |
| 3,820,705 | A * | 6/1974 | Beals | 227/113 |
| 3,834,602 | A * | 9/1974 | Obergfell | 227/120 |
| 5,004,140 | A * | 4/1991 | Fushiya et al. | 227/8 |
| 5,238,167 | A * | 8/1993 | Howard et al. | 227/110 |
| 5,495,973 | A * | 3/1996 | Ishizawa et al. | 227/8 |
| 5,647,525 | A * | 7/1997 | Ishizawa | 227/113 |
| 5,692,665 | A * | 12/1997 | Lee | 227/109 |
| 5,720,423 | A * | 2/1998 | Kondo et al. | 227/130 |
| 5,873,509 | A * | 2/1999 | Liao | 227/109 |
| 6,076,720 | A * | 6/2000 | Deng | 227/109 |
| 6,145,727 | A * | 11/2000 | Mukoyama et al. | 227/130 |
| 6,789,718 | B2 * | 9/2004 | Canlas et al. | 227/130 |
| 6,971,567 | B1 * | 12/2005 | Cannaliato et al. | 227/2 |
| 7,152,774 | B2 * | 12/2006 | Chen | 227/131 |
| 7,628,304 | B2 * | 12/2009 | Yamamoto et al. | 227/8 |
| 8,011,441 | B2 * | 9/2011 | Leimbach et al. | 173/1 |
| 8,011,547 | B2 * | 9/2011 | Leimbach et al. | 227/8 |
| 8,430,290 | B2 * | 4/2013 | Tebo | 227/120 |

* cited by examiner

*Primary Examiner* — Scott A. Smith
(74) *Attorney, Agent, or Firm* — Frederick H. Gribbell

(57) ABSTRACT

A portable hand-held fastener driving tool of the type which tends to keep the driver element better aligned with the head of the fastener while it's being driven. A biasing spring in the fastener track skews the directional path of the fastener as it is being driven, but the biasing spring does not noticeably affect the path of the driver element, thereby compensating for the slight movement of the tool (and driver) due to the tool's recoil. In an alternative embodiment, a magnet is used rather than a biasing spring, to skew the direction of the fastener as it is being shot by the tool.

19 Claims, 11 Drawing Sheets

SKEWED FASTENER TRACK FOR IMPROVED ALIGNMENT AND FASTENER DRIVABILITY

CROSS-REFERENCE TO RELATED APPLICATIONS

The present application claims priority to provisional patent application Ser. No. 61/601,487, titled "SKEWED FASTENER TRACK FOR IMPROVED ALIGNMENT AND FASTENER DRIVABILITY," filed on Feb. 21, 2012.

TECHNICAL FIELD

The technology disclosed herein relates generally to fastener driving equipment and is particularly directed to a portable hand-held tool of the type which tends to keep the driver element better aligned with the head of the fastener while it's being driven. Embodiments are specifically disclosed that include a biasing spring to "skew" the path of the fastener as it is being driven by the driver element, but the biasing spring does not noticeably affect the path of the driver element, thereby compensating for the slight movement of the tool (and driver) due to the recoil effect.

STATEMENT REGARDING FEDERALLY SPONSORED RESEARCH OR DEVELOPMENT

None.

BACKGROUND

Fastener tools tend to recoil when fired due to the forces generated by the acceleration of the fastener driver. This creates relative movement between the nail gun and the fastener as it is driven into the substrate. The driver tip is generally designed to be approximately the same size as the head of the fastener to reduce excessive marking to the substrate. Relatively small movement between the fastener and driver can cause additional marking of the substrate and in some cases the driver can prematurely slip off of the fastener leaving it sticking up above the surface. The technology disclosed herein compensates for the movement of the tool by shifting the fastener location ahead of the driver so at the end of the drive event they are approximately lined up.

An analogy is a ferry crossing a river where the sideways movement (known as leeway) due to the wind and current must be taken into account in order to arrive at the desired destination. The dock may be directly across the river but the ferry must aim upstream to compensate for the current. In the case of fastening tools, the recoil has a similar effect as the current does on the ferry. Inertia causes the fastening tool to rotate, and to therefore, the tip moves forward during the drive event. To compensate for this action, the fastener should be ejected ahead of the driver track so, as the tool moves, the driver ends up on the head of the fastener at the end of the drive stroke.

SUMMARY

It is an advantage for the driver in a fastening tool stay in contact with the head of the fastener for the entire drive event. Misalignment or movement will cause a driver mark next to the fastener which leads to an undesirable mark in the substrate. In more extreme cases, the driver can slip completely off of the fastener and leave it proud. In the case of the Fusion platform tools (sold by Senco Brands, Inc.), this issue is more prevalent due to the relatively high mass of the driver. The technology disclosed herein compensates for the tool recoil to enable the driver to stay on the fastener virtually for the entire drive event.

Additional advantages and other novel features will be set forth in part in the description that follows and in part will become apparent to those skilled in the art upon examination of the following or may be learned with the practice of the technology disclosed herein.

Still other advantages will become apparent to those skilled in this art from the following description and drawings wherein there is described and shown a preferred embodiment in one of the best modes contemplated for carrying out the technology. As will be realized, the technology disclosed herein is capable of other different embodiments, and its several details are capable of modification in various, obvious aspects all without departing from its principles. Accordingly, the drawings and descriptions will be regarded as illustrative in nature and not as restrictive.

To achieve the foregoing and other advantages, and in accordance with one aspect, a driver actuation device for a fastener driving tool is provided, which comprises: (a) a guide body that has a fastener passageway with an exit end, the guide body being configured to receive a fastener that is to be driven from the exit end; (b) a movable driver member that, when actuated for a drive event, moves from a ready position toward a driven position and contacts the fastener, thereby causing the fastener to move in a first direction to generally toward the exit end of the guide body; and (c) a biasing member that causes the fastener to change its path and move in a second direction, still generally toward the exit end of the guide body; wherein: as the driver actuation device reacts because of a recoil action due to the drive event, the driver member also changes its spatial motion so as to move generally in the second direction.

In accordance with another aspect, a driver actuation device for a fastener driving tool is provided, which comprises: (a) a guide body that has a fastener passageway with an exit end, the guide body being configured to receive a fastener that is to be driven from the exit end; (b) a movable driver member that, when actuated for a drive event, moves from a ready position toward a driven position and contacts the fastener, thereby causing the fastener to move in a first direction generally toward the exit end of the guide body; and (c) a biasing member that causes the fastener to change its path and move in a second direction, still generally toward the exit end of the guide body; however, the biasing member by itself does not substantially affect the movement direction of the driver member.

In accordance with yet another aspect, a method for adjusting the motion of a fastener in a fastener driving tool is provided, in which the method comprises the following steps: (a) providing a driver actuation device, comprising: (i) a guide body having a fastener passageway with an exit end; (ii) a movable driver member; and (iii) a biasing member; (b) initiating a drive event, and moving the driver member from a ready position toward a driven position; (c) using the driver member, contacting a fastener within the fastener passageway, thereby moving the fastener in a first direction generally toward the exit end of the guide body; (d) using the biasing member, changing a path of movement of the fastener so that it moves in a second direction, still generally toward the exit end of the guide body; and (e) by itself, the biasing member does not substantially affect the movement direction of the driver member.

Still other advantages will become apparent to those skilled in this art from the following description and drawings wherein there is described and shown a preferred embodiment in one of the best modes contemplated for carrying out the technology. As will be realized, the technology disclosed herein is capable of other different embodiments, and its several details are capable of modification in various, obvious aspects all without departing from its principles. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the technology disclosed herein, and together with the description and claims serve to explain the principles of the technology. In the drawings:

DETAILED DESCRIPTION

Figure 1A:
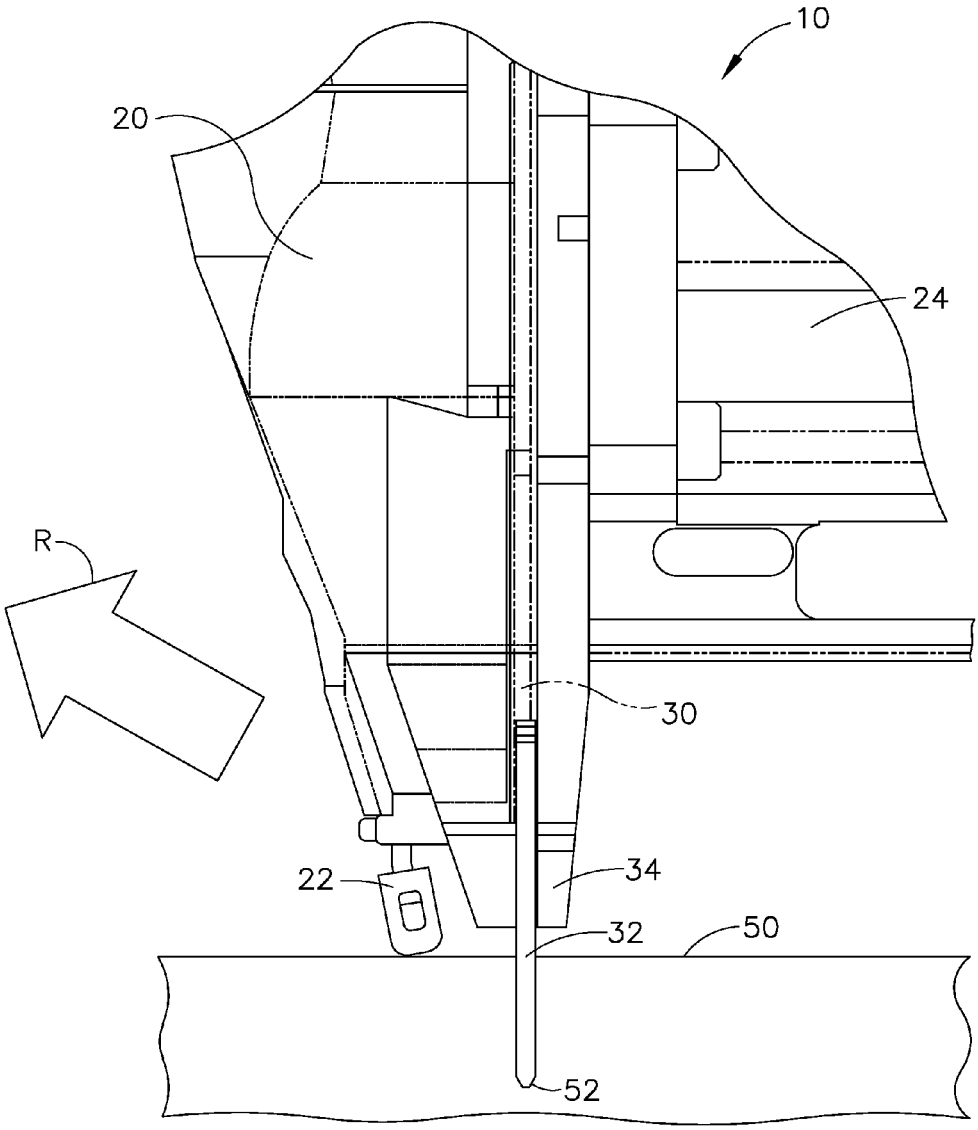
FIG. 1A (PRIOR ART)
FIGS. 1A, 1B, and 1C are elevational views of the exit end of a conventional fastener driving tool known in the prior art, illustrating three different stages of a firing sequence.

Reference will now be made in detail to the present preferred embodiment, an example of which is illustrated in the accompanying drawings, wherein like numerals indicate the same elements throughout the views.

It is to be understood that the technology disclosed herein is not limited in its application to the details of construction and the arrangement of components set forth in the following description or illustrated in the drawings. The technology disclosed herein is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

The terms "first" and "second" preceding an element name, e.g., first inlet, second inlet, etc., are used for identification purposes to distinguish between similar or related elements, results or concepts, and are not intended to necessarily imply order, nor are the terms "first" and "second" intended to preclude the inclusion of additional similar or related elements, results or concepts, unless otherwise indicated.

DEFINITIONS

Fastening Tools: also known as nail guns, staplers and pinners; also sometimes referred to as fastener driving tools.

Proud Fastener: Fastener not driven below the surface of the substrate.

Substrate: Wood or composite material that the fastener is being driven into, also referred to as the workpiece.

Driver: The part on the nail gun tool that pushes the fastener into the substrate.

Fastener: Nail, staple, or pin.

Drive Event: the action of the driver starting from its cocked position until it reached its fully extended position.

Driver Mark: the mark or dent left in the substrate after the drive event. Ideally this is no larger than the head of the fastener.

"Fusion" Tools: Electro-pneumatic line of fastener driving tools sold by Senco Brands, Inc. A detailed description of many aspects of the Fusion tool is provided in U.S. Pat. No. 8,011,547, titled "FASTENER DRIVING TOOL USING A GAS SPRING."

Fastener Track: The track in the fastening tool that guides the fastener to the workpiece.

Driver Track: The track in the fastening tool that guides the driver to the workpiece.

Operation of Tool

Newton's Third law states that the mutual forces of action and reaction between two bodies are equal, opposite, and collinear. In the case of a fastening tool, this means that the force to accelerate the piston/driver also acts on the body of the fastening tool. Since the fastening tool has much more mass than the driver, its velocity is significantly less, however, it still moves during the drive event, and typically is referred to as a "recoil." The recoil phenomenon is present in all types of fastening tools, but is more prevalent in the Fusion tools (sold by Senco Brands, Inc.) because they have a particularly heavy driver, since the lift mechanism is coupled to the driver. Proportionately, if more power is desired for larger fasteners and/or harder substrates, increasing the pressure to increase the driver force increases the recoil and exacerbates the problem. Analysis and high-speed photography confirm this issue. See FIGS. 1A-1C for an illustration of the timeline.

Referring now to FIG. 1A, a conventional tool (such as an early model Fusion tool, sold by Senco Brands, Inc.), generally designated by the reference numeral 10, is illustrated as having just begun a drive event. The tool 10 includes a front portion 20, a safety element 22 that contacts a workpiece surface 50 to initiate a fastener driving cycle (or drive event) if the tool's trigger is pulled, a magazine 24 that contains at least one fastener, a driver 30, a fastener 32 being driven, and a back plate portion 34. In FIG. 1A, the driver 30 to has moved downward (in this view) and has dislodged the "lead fastener" 32 from the magazine 24, and this lead fastener has just started being driven into the workpiece at 50. The leading tip of the fastener is depicted at 52. When the tool fires, it rotates about its center of gravity (or mass), essentially in a rotational direction as indicated by the arrow "R". The leading tip of the driver 30 is in contact with the head 54 of the fastener at this time.

Figure 1B:
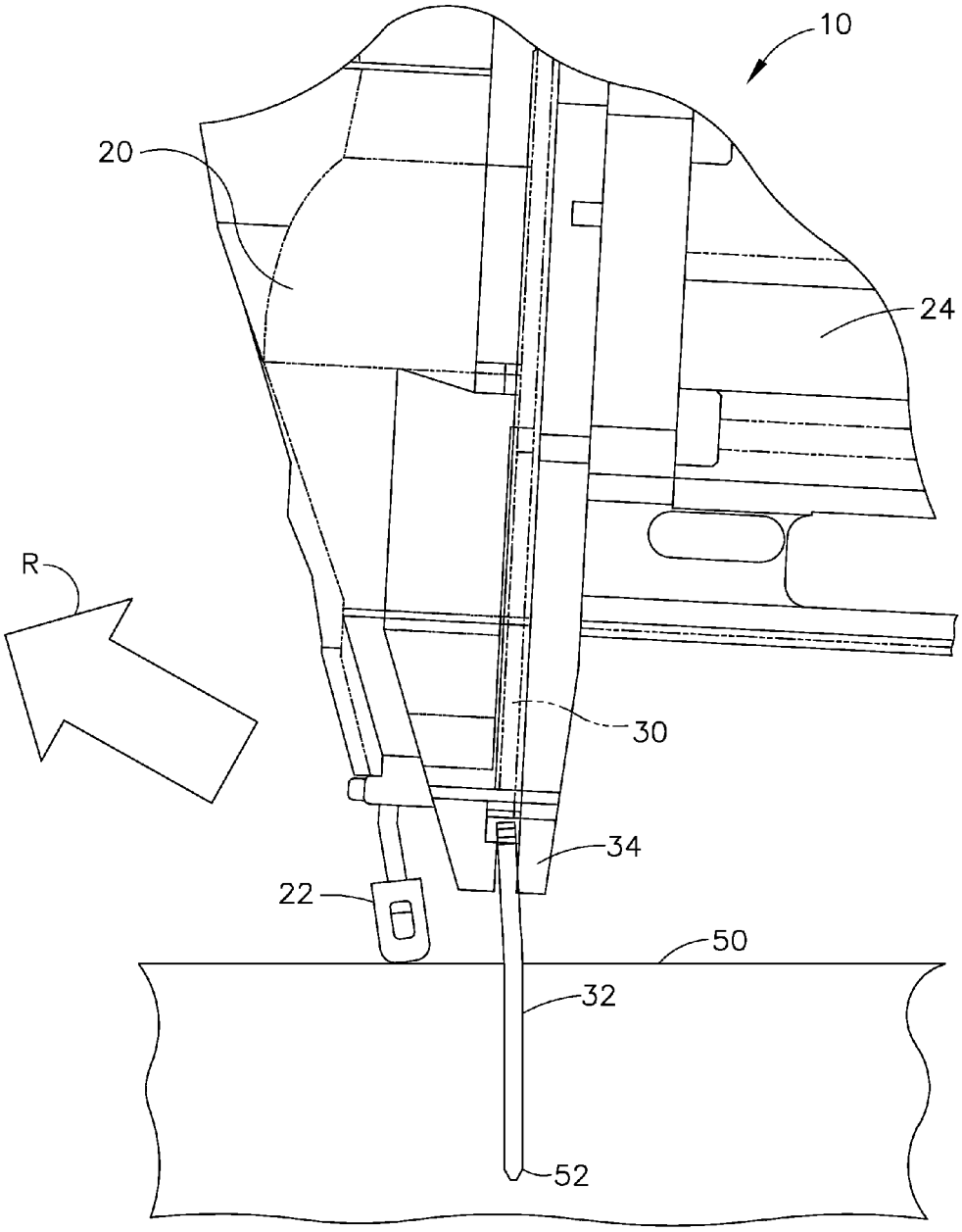
FIG. 1B (PRIOR ART)
Figure 1C:
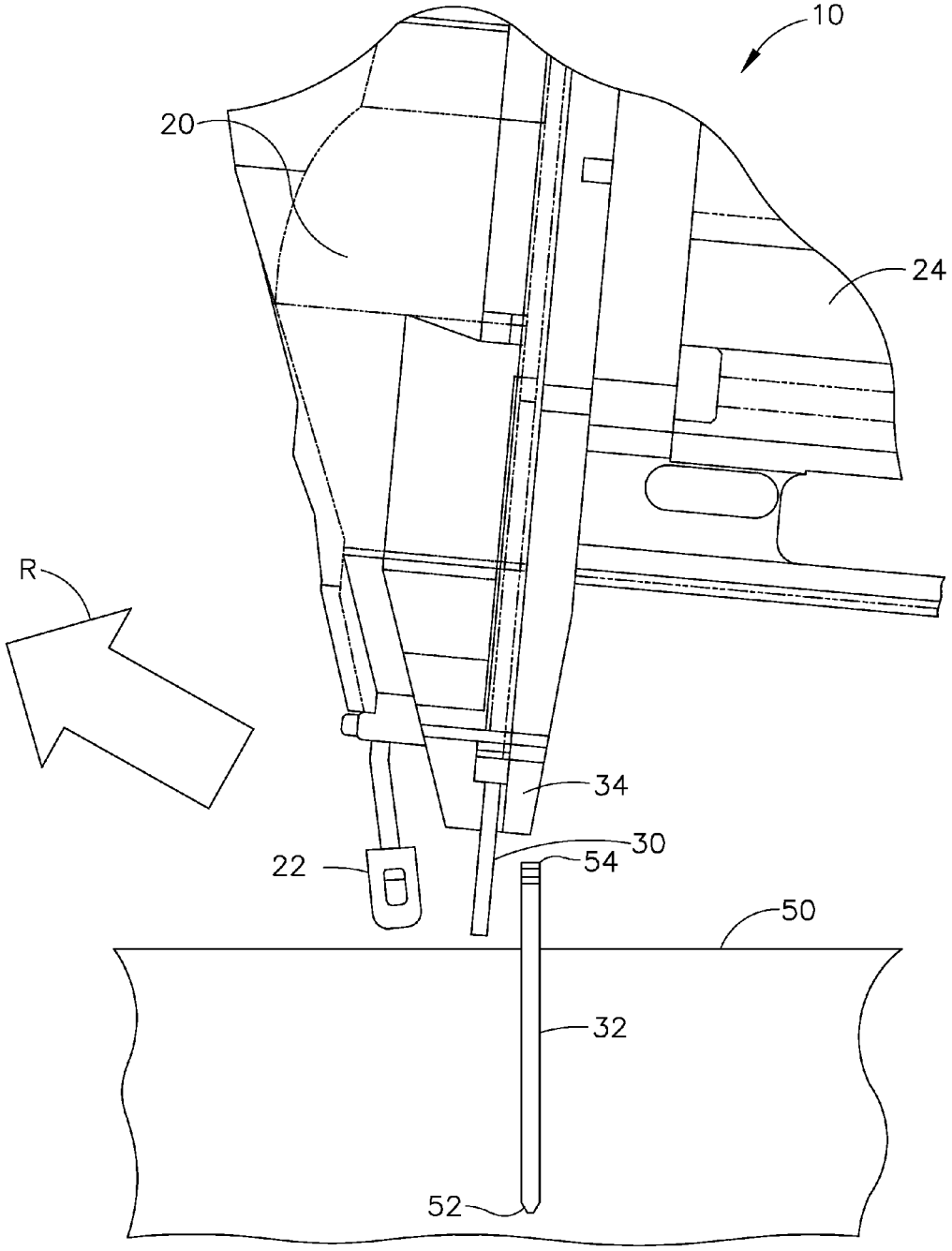
FIG. 1C (PRIOR ART)

Referring now to FIG. 1B, the fastener 32 is now stuck in the substrate 50 as the tool 10 continues to move (in the direction R), slightly bending the fastener. Once the fastener 32 exits the fastener track, the driver 30 can slip off the head 54 of the fastener, thereby leaving it proud in some circumstances. This condition is illustrated in FIG. 1C. As noted above, the recoil effect in Senco's Fusion tool is more prevalent due to the relatively high mass of the driver; the recoil can cause a displacement near the exit area (at 110, see below) of greater than 0.03 inches.

Figure 2A:
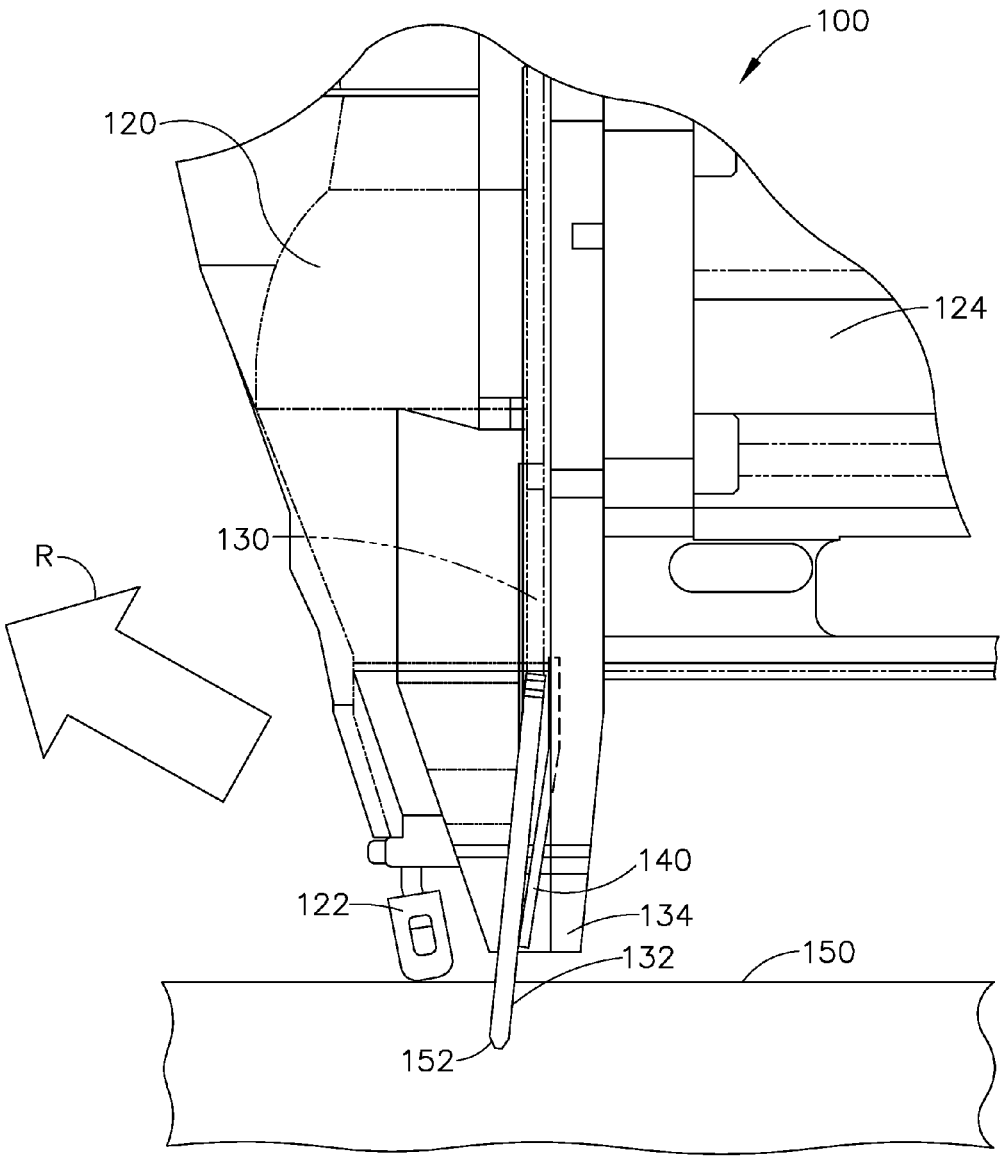
FIGS. 2A, 2B, and 2C are elevational views of the exit end of a fastener driving tool, as constructed according to the principles of the technology disclosed herein, illustrating three different stages of a firing sequence.

Referring now to FIG. 2A, a tool 100 constructed according to the principles of the technology disclosed herein is illustrated as having just begun a drive event. The tool 100 includes a front portion 120, a safety element 122 that contacts a workpiece surface 150 to initiate a fastener driving cycle (or drive event) if the tool's trigger (not shown in this view) is pulled, a magazine 124 that contains at least one fastener, a driver (or "driver member") 130, a fastener 132 being driven, and a back plate portion 134. Tool 100 includes a biasing member 140, which has a function that will be explained below. In this embodiment, biasing member 140 comprises a leaf spring.

It will be understood that the biasing member 140 could easily be made of other mechanical components, such as a rigid piece of material that was hinged on one end, and spring-loaded by use of one or more coil springs, for example. A plastic hinge could also be used, although such devices might not have suitable durability for an industrial-grade power tool.

As can be seen in the other views, tool 100 also includes a gas spring storage chamber 102, a battery 104, a driver track 144, a fastener track 146, and a front plate 126 (on the opposite side of the driver track 144 and the fastener track 146 from the back plate 134). There is an "exit area" (or "exit end") of the tool, as indicated by the reference numeral 110 on FIG. 2B. The front plate 126 and back plate 134 generally combine into an overall structure, sometimes referred to herein as a "guide body," that contains passageways for to guiding the driver 130 and for guiding individual fasteners 132; these passageways are generally referred to herein as the above-noted driver track 144 and fastener track 146.

Figure 2B:
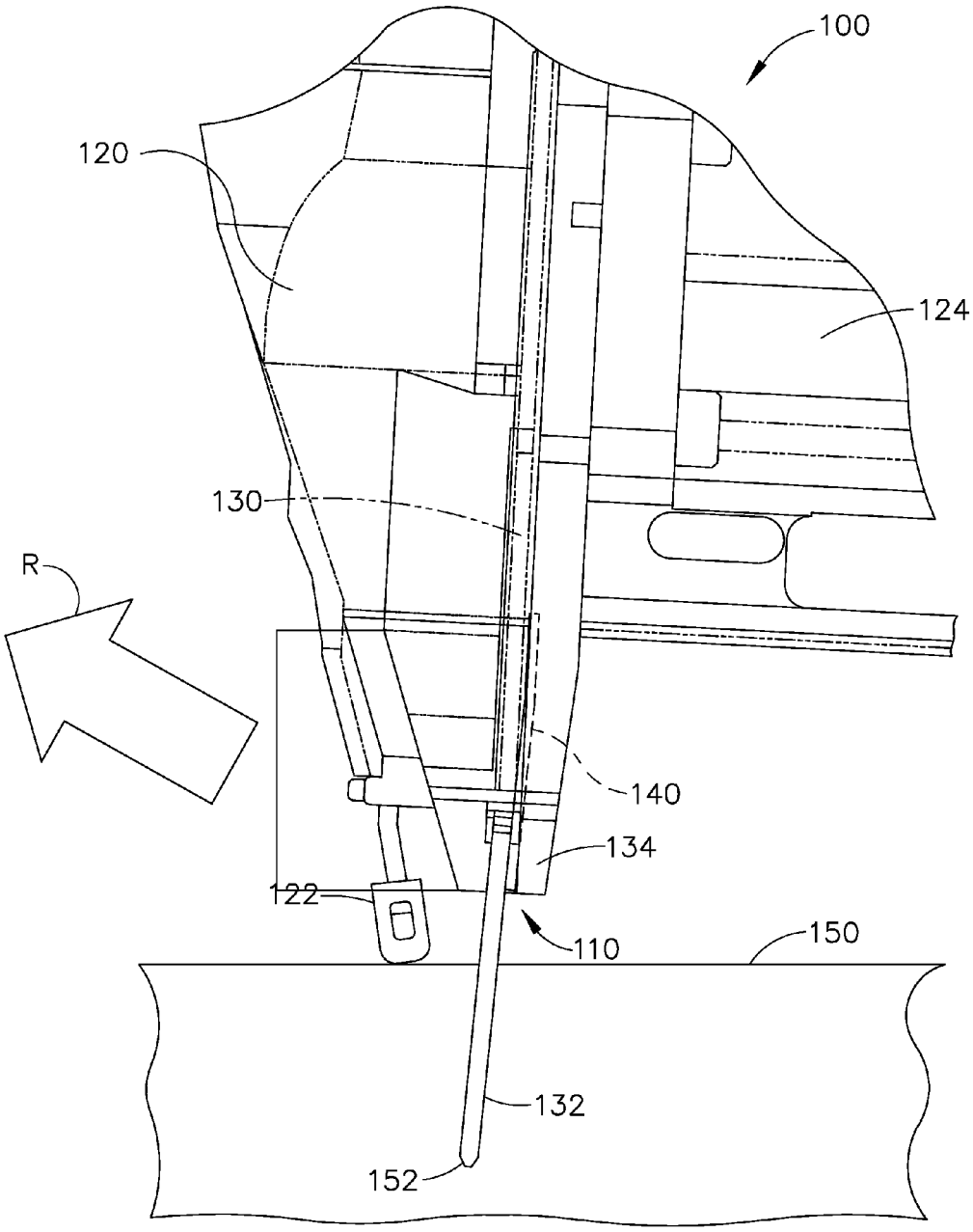
Figure 2C:
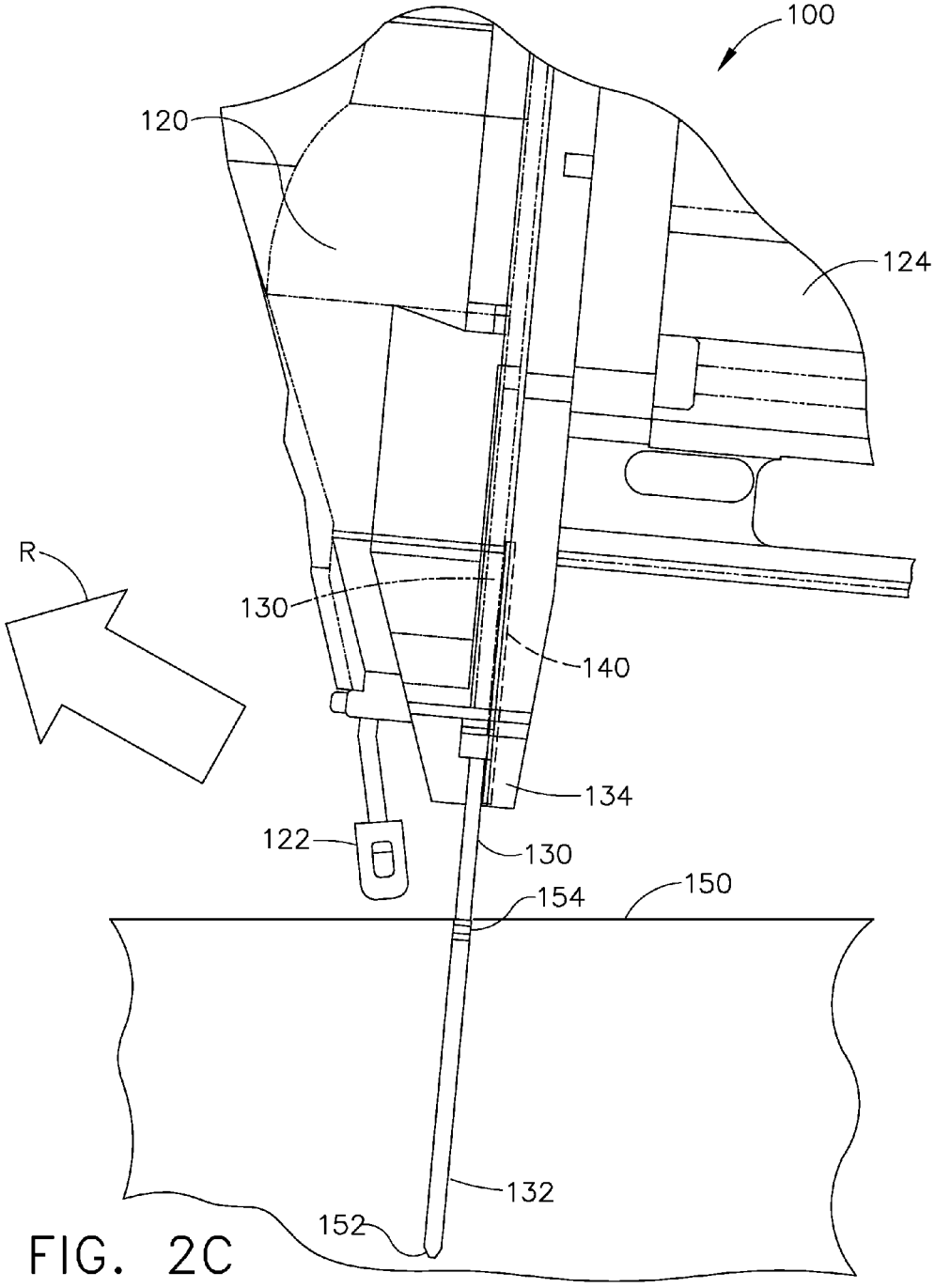

The driver 130 begins its driving cycle at a "ready position," which is upward as viewed in FIGS. 2A-2C. After the tool 100 is actuated, the driver 130 is pushed downward (in these views) toward a "driven position." During its movement between the ready position and driven position, the driver contacts one of the fasteners that are held in the magazine 124.

In FIG. 2A, the driver 130 has moved downward (in this view) and has already dislodged the "lead fastener" 132 from the magazine 124, and this lead fastener has just started being driven into the workpiece at 150. The leading tip of the fastener is depicted at 152. When the tool fires, it tends to rotate about its center of gravity (or mass), essentially in a rotational direction as indicated by the arrow "R". This rotation is the tool's reaction to the driver 130 being quickly accelerated; it is commonly referred to as the "recoil." The biasing member 140 (a leaf spring in this embodiment) tends to bias the fastener 132 toward the front (i.e., to the left in this view) of the driver track 144. The leading tip of the driver 130 is in contact with the head 154 of the fastener at this time.

The technology disclosed herein compensates for the tool recoil by repositioning the fastener in the fastener track during the drive event. After the fastener 132 is separated from the strip in the magazine 124, the fastener track 146 provides clearance and a spring force to move the fastener 132 relative to the driver 130. Once the fastener starts to penetrate the substrate 150, it becomes fixed and no longer moves along with the fastening tool 100. The overall effect is that, as the tool reacts, (i.e., rotates in the direction R), the fastener 132 moves back into alignment with the movements of the driver 130. This is the circumstance that is illustrated in FIG. 2B.

The leading tip 152 of the fastener 132 is pushed by a light spring 140 and thus is ejected ahead of the driver track 144 so, as the tool recoils, the driver 130 catches up to the head 154 of the fastener 132 by the end of the drive event. The driver 130 is held in a driver track 144 that moves in conjunction with the fastener tool 100, so there is inherently motion between the fastener 132 and the tool 100, once the fastener has entered the substrate 150. By the time the head 154 of the fastener exits the fastener track 146, the driver 130 has come back into alignment with the fastener 132, for a complete drive (see FIG. 2C). This ensures that the driver 130 stays on the fastener 132 essentially for the duration of the drive event and minimizes any driver mark and the possibility of slipping off the fastener.

The Fusion fastener driving tool starts with a cocked piston and the driver tip slightly above a strip of collated fasteners (stored in a magazine 124). The driver 130 is loaded by a gas spring with approximately 160 pounds of force. It is released using an electro-mechanical quick release mechanism which allows the driver to accelerate to a velocity of over 100 feet/second in a few milliseconds. The acceleration during the drive event creates a force that causes the fastener tool 100 to recoil about its center of gravity (see FIG. 3). The "center of rotation" at 105 is located at the center of mass of the tool 100.

The first fastener is held in position for the driver to shear it off from the collated strip of the magazine 124 and push it down the fastener track 146. The tip 152 of the dislodged fastener 132 is pushed forward (i.e., the direction "forward" in this description is to the left, in the views of FIGS. 2A-2C and FIG. 3) by a biasing member 140 (e.g., a leaf spring) into a clearance 128 provided in the fastener track 146. This biasing action pushes the fastener tip 152 to a second direction that is forward of the driver track 144 at this point in the drive event. Once the fastener 132 enters the substrate 150, it no longer moves with the rotational motion of fastening tool 100.

The fastening tool 100 continues to rotate during the drive event, which tends to cause a relative horizontal movement between the fastener track 146 and the fastener 132. The biasing member (e.g., leaf spring 140) is designed to not be strong enough to alter the drive path of the driver 130, so the driver's path becomes slightly behind the path of the fastener 132. (Note: in this description, the direction "behind" is to the right, in the views of FIGS. 2A-2C and FIG. 3.) Since the tool 100 is rotating (see arrow R) about the center of gravity 105 with a horizontal relative movement near the exit area 110, at the end of the drive event the driver 130 and fastener 132 are in approximate alignment. Even though the recoil effect can cause a displacement of greater than 0.03 inches near the exit area 110, this effect is corrected by the technology disclosed herein.

Another way to describe these actions is that the movable driver 130, when actuated for a drive event, moves from its ready position toward its driven position, and while doing so, it contacts the fastener 132. This contact causes the fastener to move in a first direction that is generally toward the exit end 110 of the guide body (i.e., the assembly made to up of the front plate 126, back plate 134, and other parts of the tool in that region of the tool). This first direction is along the driver track 144 at the initial time when the driver 130 first begins movement—i.e., before the driver contacts the fastener, and before the tool undergoes a significant amount of reaction motion due to recoil. The biasing member 140 now causes the fastener 132 to change its path and then to move in a second direction, which still is generally toward the exit end 110 of the guide body. As the tool 100 rotates because of the recoil action, the driver 130 also changes its spatial motion—in turn, as an integral part of the tool—so as to move generally in the (same) second direction, and to again contact, or maintain contact with, the head of the fastener 132. Without this change in vector movements, from the first direction to the second direction, the driver tip might lose contact with the head 154 of the fastener 132, as described above, and fail to completely drive the fastener into the substrate 150.

It will be understood that the spatial vector movements of the fastener 132 do not change from the first (spatial) direction to the second (spatial) direction in an instant, because of the biasing member 140. It is more correct to say that there is a gradual transition from the first direction to the second direction as the biasing member 140 has a chance to act upon the fastener 132, as the fastener moves by the position of the biasing member. These movements, of course, occur quite quickly, so the fastener's change in direction will essentially appear to an observer to be instantaneous.

It will also be understood that another way to describe these actions is that the driver 130 itself changes direction, as the tool 100 undergoes recoil movement. In fact, the driver will change direction (e.g., from the first direction to the second direction) with, or without, the use of any biasing member in the tool. Of course, that attribute is the main reason for equipping the tool 100 with the biasing member 140, so that the fastener 132 will also change its path of movement from the first direction to the second direction, and in so doing, skewing the travel of the fastener so that its head 154 meets up once again with the contacting tip of the driver 130, and thereby become completely driven into the substrate 150.

Figure 3:
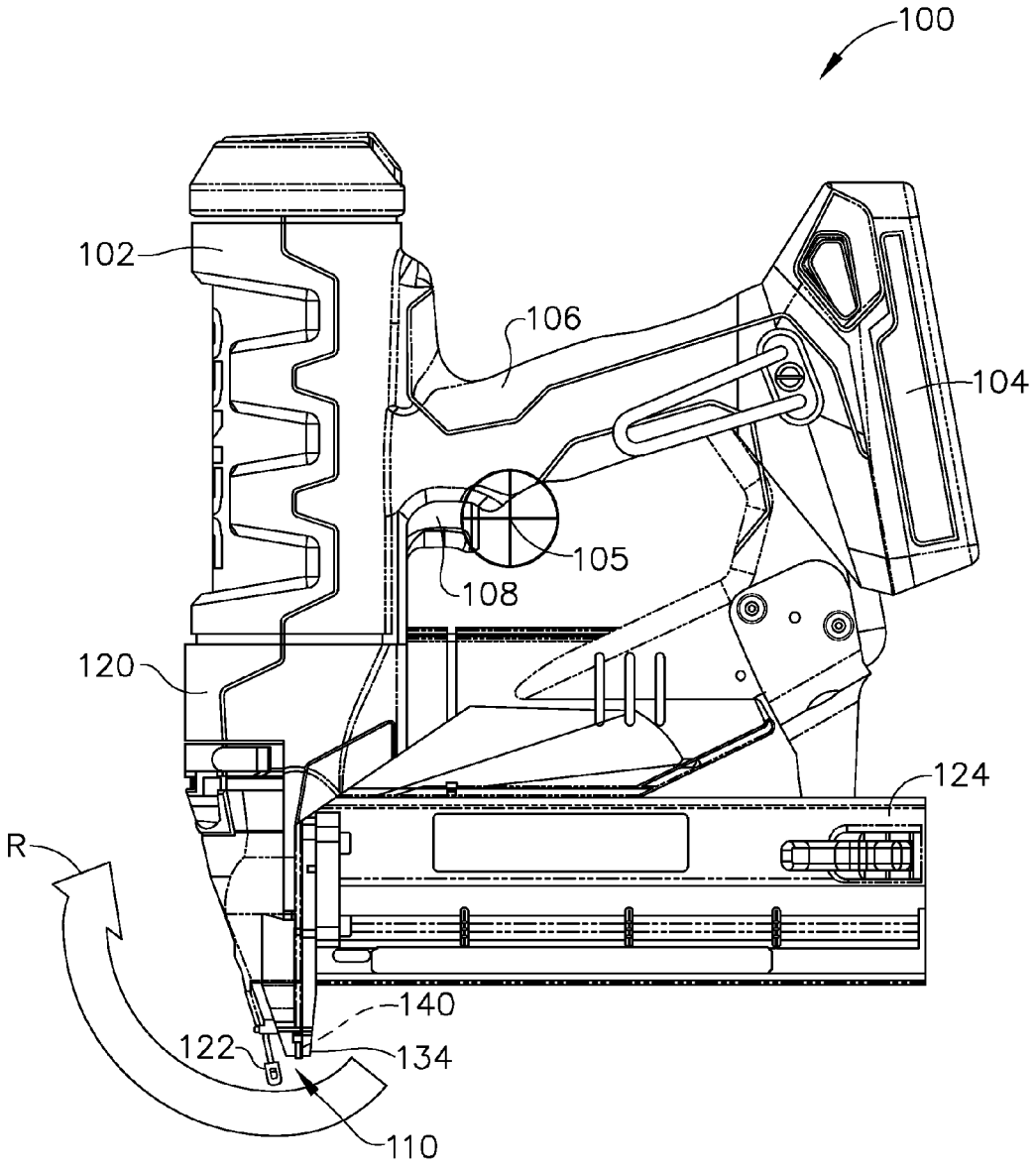
FIG. 3 is an elevational view of the entire fastener driving tool of FIG. 2.

FIG. 3 also illustrates some of the other portions of the tool 100 that are not visible in FIGS. 2A-2C, such as the gas spring storage chamber 102, the battery 104, the handle 106, the hand-operated trigger 108, and the location of the center of rotation 105. The direction of rotation "R" is indicated in this view. It should be noted that the center of rotation 105 is intentionally located near the trigger 108 and handle 106 portions of the tool, to minimize the reaction movements of the tool (due to recoil) as those movements are experienced by the human user.

Figure 4:
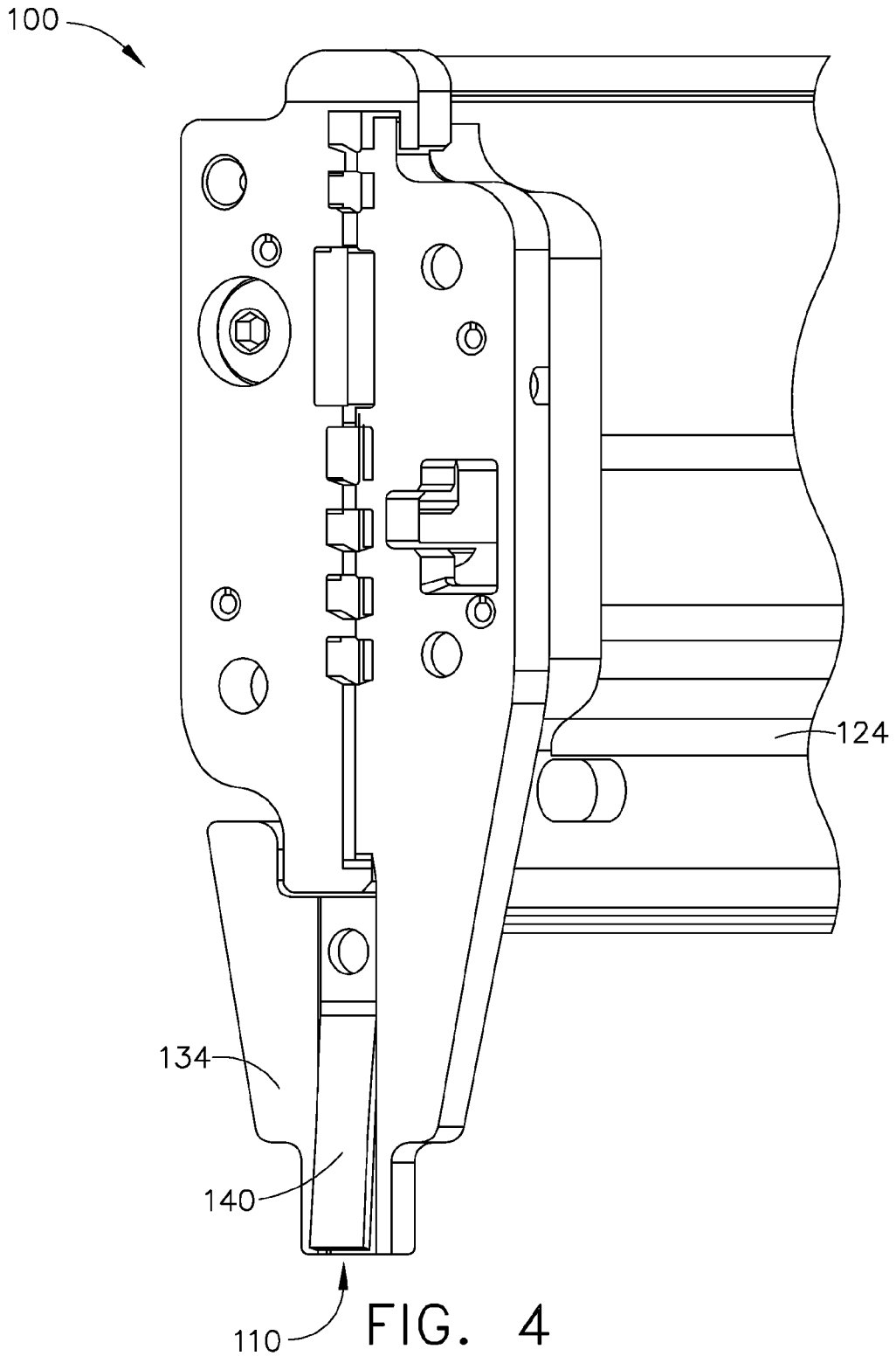
FIG. 4 is an elevational view of a back plate and magazine rail of the fastener driving tool of FIG. 2.

FIG. 4 illustrates the back plate and rail portion of the tool 100 in greater detail. The magazine rail is indicated at 124, the back plate portion is at 134, and the biasing member 140 is depicted as a leaf spring, as per this first embodiment. The exit area 110 (or "exit end" portion of the tool) is indicated at the bottom (in this view) of the figure. The back plate 134 forms one side of the fastener track 146, particularly at the location of the leaf spring 140.

Figure 5:
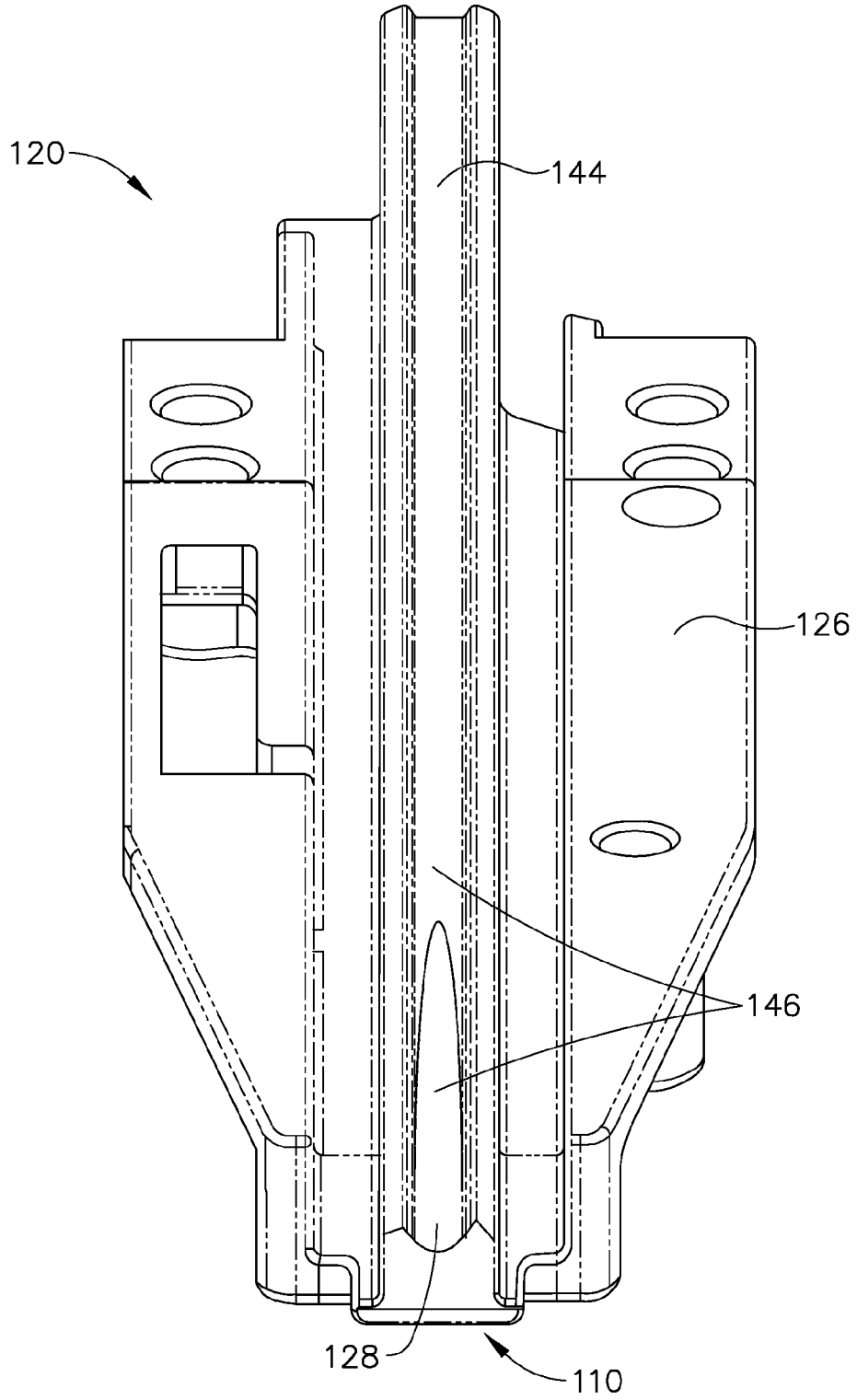
FIG. 5 is an elevational view of a front plate of the fastener driving tool of FIG. 2.

FIG. 5 illustrates the front portion 120 of the tool 100, specifically the front plate 126. This front plate 126 forms the other side of the driver track 144 and the other side of the fastener track 146, as indicated on the figure. There is a relief area 128 for the fastener to travel through, due to the biasing action of the biasing member 140. The fastener track 146 terminates at the exit area 110.

Figure 6:
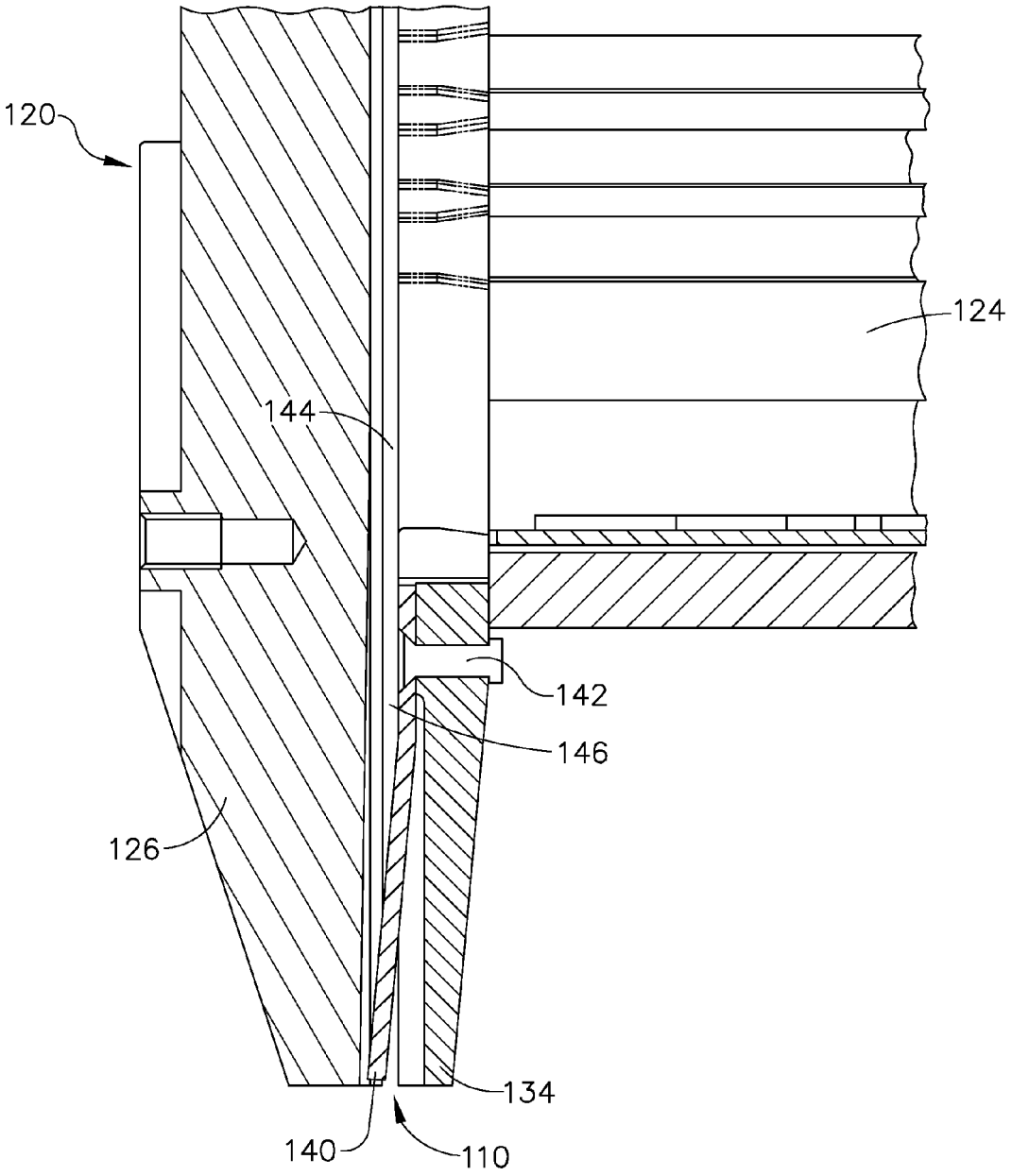
FIG. 6 is an elevational view of an assembled exit portion of the fastener driving tool of FIG. 2, showing the front plate and back plate areas, in which a leaf spring acts as the biasing member.

FIG. 6 illustrates the assembled exit end portion of the tool 100, in an elevational side view, depicting the tool as it would be used to project a fastener in a downward, near-vertical direction. The front portion 120 includes the front plate 126; the rear portion includes the back plate 134 and the fastener magazine 124. Those two plates 126, 134 essentially create the fastener track 146, which terminates at the exit area 110. The leaf spring biasing member 140 can be seen, and is attached to the back plate 134 by a rivet 142 in this embodiment. Of course, other methods of attachment could be utilized. As a fastener 132 is shot down the fastener track 146, its path will be skewed by mechanical force, i.e., the biasing contact of the leaf spring 140 in this first embodiment.

Figure 7:
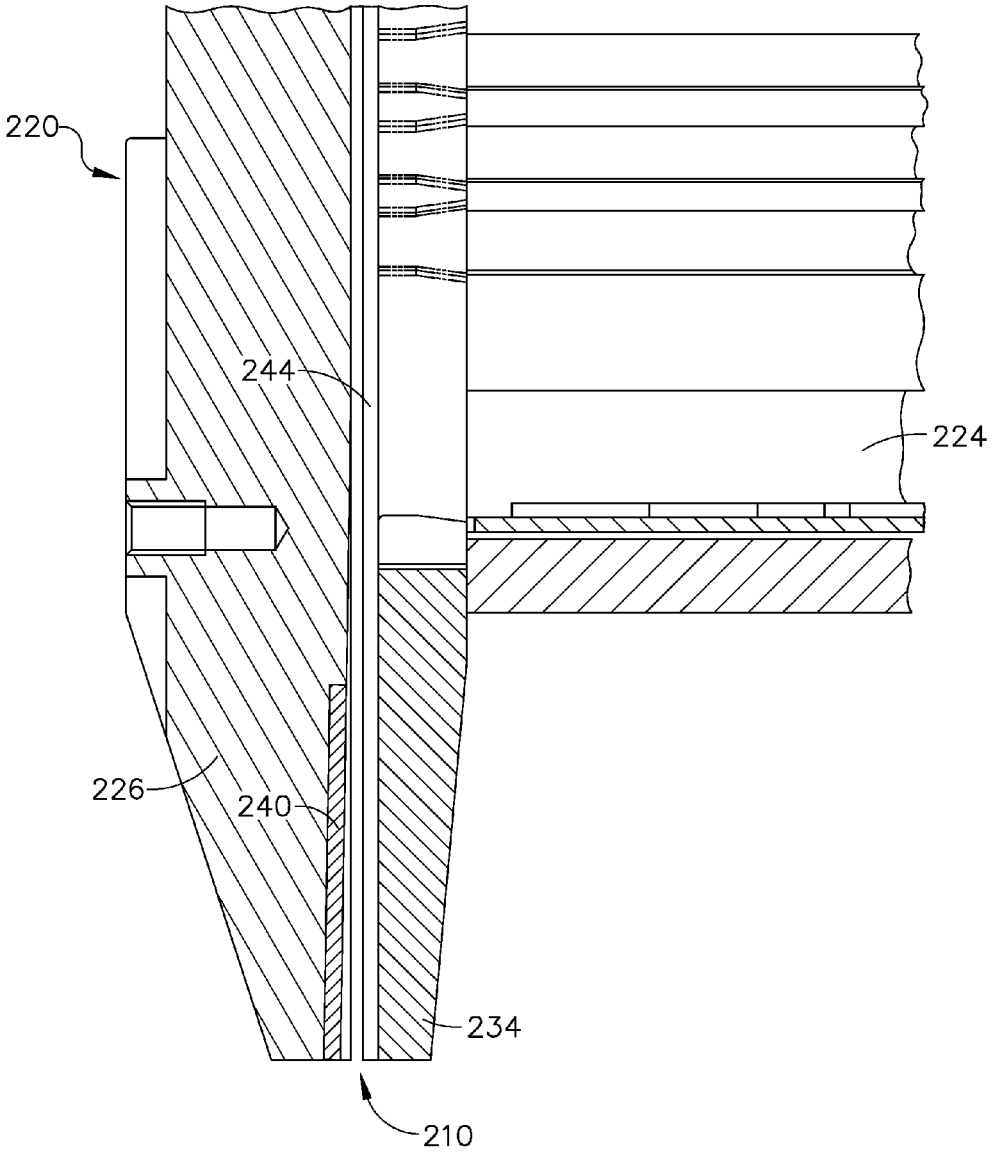
FIG. 7 is an elevational view of an assembled exit portion of a second embodiment of the fastener driving tool of FIG. 2, showing the front plate and back plate areas, in which a magnet acts as the biasing member.

FIG. 7 is similar to FIG. 6, in that it illustrates the assembled exit end portion of a tool in an elevational side view, depicting the tool as it would be used to project a fastener in a downward, near-vertical direction. However, in FIG. 7, a second embodiment is disclosed which uses a magnet as the biasing member 240. In this second embodiment, the front portion is designated by the reference numeral 220, which includes a front plate 226; a rear portion includes a back plate 234 and a fastener magazine 224. Those two plates 226, 234 essentially create a fastener track 246, which terminates at an exit area 210.

In this alternative embodiment, when a metal fastener is shot down the fastener track 246, its path will be skewed by magnetic force, rather than by mechanical to force. The magnet 240 may be positioned flush along the fastener track (within the front plate), or the magnet could be placed in a recess, and perhaps even covered by a thin layer of non-magnetic material (within the front plate), to avoid any possible physical contact with outside objects. The driver (not shown in this view) could be made of a non-magnetic material, although that is not necessary because of its greater mass.

Nailing tools that have been available on the market typically have collinear fastener and driver tracks. Although earlier conventional tools recoil, that recoil is generally not to the extent that the Fusion tools recoil, since the Fusion tools have a significantly heavier driver. In any event, conventional nailing tools also can benefit from this technology, although the skew due to recoil may not be as great as what the Fusion tools undergo.

In conclusion, some of the features disclosed herein include, but are not limited to:

(a) A fastener driving tool with its driver track skewed from the fastener track in order to compensate for tool recoil.

(b) The driver track and fastener track may be skewed angularly.

(c) The driver track and fastener track may be offset but parallel.

(d) A driven fastener can be guided in fastener track magnetically.

(e) A driven fastener can be guided in fastener track with a spring.

(f) A driven fastener can be guided in fastener track with a following fastener.

(g) A fastener driving tool with a fastener track which has a biasing member that affects the direction of movement of fasteners, but that does not substantially affect the movement direction of the driver.

As used herein, the term "proximal" can have a meaning of closely positioning one physical object with a second physical object, such that the two objects are perhaps adjacent to one another, although it is not necessarily required that there be no third object positioned therebetween. In the technology disclosed herein, there may be instances in which a "male locating structure" is to be positioned "proximal" to a "female locating structure." In general, this could mean that the two male and female structures are to be physically abutting to one another, or this could mean that they are "mated" to one another by way of a particular size and shape that essentially keeps one structure oriented in a predetermined direction and at an X-Y (e.g., horizontal and vertical) position with respect to one another, regardless as to whether the two male and female structures actually touch one another along a continuous surface. Or, two structures of any size and shape (whether male, female, or otherwise in shape) may be located somewhat near one another, regardless if they physically abut one another or not; such a relationship could still be termed "proximal." Or, two or more possible locations for a particular point can be specified in relation to a precise attribute of a physical object, such as being "near" or "at" the end of a stick; all of those possible near/at locations could be deemed "proximal" to the end of that stick. Moreover, the term "proximal" can also have a meaning that relates strictly to a single object, in which the single object may have two ends, and the "distal end" is the end that is positioned somewhat farther away from a subject point (or area) of reference, and the "proximal end" is the other end, which would be positioned somewhat closer to that same subject point (or area) of reference.

It will be understood that the various components that are described and/or illustrated herein can be fabricated in various ways, including in multiple parts or as a unitary part for each of these components, without departing from the principles of the technology disclosed herein. For example, a component that is included as a recited element of a claim hereinbelow may be fabricated as a unitary part; or that component may be fabricated as a combined structure of several individual parts that are assembled together. But that "multi-part component" will still fall within the scope of the claimed, recited element for infringement purposes of claim interpretation, even if it appears that the claimed, recited element is described and illustrated herein only as a unitary structure.

All documents cited in the Background and in the Detailed Description are, in relevant part, incorporated herein by reference; the citation of any document is not to be construed as an admission that it is prior art with respect to the technology disclosed herein. Two United States patents that are assigned to Senco Brands, Inc. are incorporated herein by reference in their entirety: these patents are U.S. Pat. No. 8,011,547, titled "FASTENER DRIVING TOOL USING A GAS SPRING;" and U.S. Pat. No. 8,011,441, titled "METHOD FOR CONTROLLING A FASTENER DRIVING TOOL USING A GAS SPRING."

The foregoing description of a preferred embodiment has been presented for purposes of illustration and description. It is not intended to be exhaustive or to limit the to technology disclosed herein to the precise form disclosed, and the technology disclosed herein may be further modified within the spirit and scope of this disclosure. Any examples described or illustrated herein are intended as non-limiting examples, and many modifications or variations of the examples, or of the preferred embodiment(s), are possible in light of the above teachings, without departing from the spirit and scope of the technology disclosed herein. The embodiment(s) was chosen and described in order to illustrate the principles of the technology disclosed herein and its practical application to thereby enable one of ordinary skill in the art to utilize the technology disclosed herein in various embodiments and with various modifications as are suited to particular uses contemplated. This application is therefore intended to cover any variations, uses, or adaptations of the technology disclosed herein using its general principles. Further, this application is intended to cover such departures from the present disclosure as come within known or customary practice in the art to which this technology disclosed herein pertains and which fall within the limits of the appended claims.

What is claimed is:

1. A driver actuation device for a fastener driving tool, said driver actuation device comprising:

(a) a guide body that has a fastener passageway with an exit end, said guide body being configured to receive a fastener that is to be driven from said exit end;

(b) a movable driver member that, when actuated for a drive event, moves from a ready position toward a driven position and contacts said fastener, thereby causing said fastener to move in a first direction generally toward said exit end of the guide body; and (c) a biasing member that causes said fastener to change its path and move in a second direction, still generally toward said exit end of the guide body;

wherein: as said driver actuation device reacts because of a recoil action due to said drive event, said driver member also changes its spatial motion so as to move generally in said second direction.

2. The driver actuation device of claim 1, wherein said biasing member comprises one of: (a) a leaf spring; (b) a hinged member that is spring-loaded; and (c) a magnet.

3. The driver actuation device of claim 1, wherein said biasing member substantially affects the movement direction of said fastener, but does not substantially affect the movement direction of said driver member.

4. The driver actuation device of claim 1, further comprising a driver track between said ready position and said driven position of the driver member; wherein: (a) said fastener passageway comprises a fastener track; and (b) said fastener track and said driver track are skewed angularly.

5. The driver actuation device of claim 1, further comprising a driver track between said ready position and said driven position of the driver member; wherein: (a) said fastener passageway comprises a fastener track; and (b) said fastener track and said driver track are offset but substantially parallel to one another.

6. The driver actuation device of claim 1, wherein said driver member again contacts said fastener after said fastener has changed its direction of movement to said second direction.

7. The driver actuation device of claim 1, wherein said driver member remains substantially in continuous contact with said fastener after said fastener has changed its direction of movement to said second direction.

8. A driver actuation device for a fastener driving tool, said driver actuation device comprising:

(a) a guide body that has a fastener passageway with an exit end, said guide body being configured to receive a fastener that is to be driven from said exit end;

(b) a movable driver member that, when actuated for a drive event, moves from a ready position toward a driven position and contacts said fastener, thereby causing said fastener to move in a first direction generally toward said exit end of the guide body; and (c) a biasing member that causes said fastener to change its path and move in a second direction, still generally toward said exit end of the guide body; however, said biasing member by itself does not substantially affect the movement direction of said driver member.

9. The driver actuation device of claim 8, wherein said biasing member comprises one of: (a) a leaf spring; (b) a hinged member that is spring-loaded; and (c) a magnet.

10. The driver actuation device of claim 8, further comprising a driver track between said ready position and said driven position of the driver member; wherein: (a) said fastener passageway comprises a fastener track; and (b) said fastener track and said driver track are skewed angularly.

11. The driver actuation device of claim 8, further comprising a driver track between said ready position and said driven position of the driver member; wherein: (a) said fastener passageway comprises a fastener track; and (b) said fastener track and said driver track are offset but substantially parallel to one another.

12. The driver actuation device of claim 8, wherein said driver member again contacts said fastener after said fastener has changed its direction of movement to said second direction.

13. The driver actuation device of claim 8, wherein said driver member remains substantially in continuous contact with said fastener after said fastener has changed its direction of movement to said second direction.

14. A method for adjusting the motion of a fastener in a fastener driving tool, said method comprising:

(a) providing a driver actuation device, comprising:
  (i) a guide body having a fastener passageway with an exit end;
  (ii) a movable driver member; and
  (iii) a biasing member;

(b) initiating a drive event, and moving said driver member from a ready position toward a driven position;

(c) using said driver member, contacting a fastener within said fastener passageway, thereby moving said fastener in a first direction generally toward said exit end of the guide body;

(d) using said biasing member, changing a path of movement of said fastener so that it moves in a second direction, still generally toward said exit end of the guide body; and (e) by itself, said biasing member does not substantially affect the movement direction of said driver member.

15. The method of claim 14, wherein said biasing member comprises one of: (a) a leaf spring; (b) a hinged member that is spring-loaded; and (c) a magnet.

16. The method of claim 14, further comprising a driver track between said ready position and said driven position of the driver member; wherein: (a) said fastener passageway comprises a fastener track; and (b) said fastener track and said driver track are skewed angularly.

17. The method of claim 14, further comprising a driver track between said ready position and said driven position of the driver member; wherein: (a) said fastener passageway comprises a fastener track; and (b) said fastener track and said driver track are offset but substantially parallel to one another.

18. The method of claim 14, further comprising the step of: said driver member changing its spatial direction of movement, due to a recoil reaction of said tool, and again contacting said fastener after said fastener has changed its direction of movement to said second direction.

19. The method of claim 14, further comprising the step of: said driver member changing its spatial direction of movement, due to a recoil reaction of said tool, and remaining substantially in continuous contact with said fastener after said fastener has changed its direction of movement to said second direction.

* * * * *